United States Patent [19]

Ikeura et al.

[11] Patent Number: 4,825,833

[45] Date of Patent: May 2, 1989

[54] ENGINE CONTROL APPARATUS

[75] Inventors: Kenji Ikeura, Zushi; Yoshihisa Kawamura, Yokusuka; Masami Nagano, Katsuta; Seiji Suda, Mito, all of Japan

[73] Assignees: Hitachi, Ltd.; Nissan Motor Co., Ltd., both of Tokyo, Japan

[21] Appl. No.: 46,445

[22] Filed: May 6, 1987

[30] Foreign Application Priority Data

May 10, 1986 [JP] Japan ..... 61-105842

[51] Int. Cl.[4] ..... F02D 41/14

[52] U.S. Cl. ..... 123/435; 123/336

[58] Field of Search ..... 123/478, 435, 436, 336, 123/399, 350, 340, 425

[56] References Cited

U.S. PATENT DOCUMENTS

| | | | |
|---|---|---|---|
| 4,168,679 | 9/1979 | Ikeura et al. | 123/489 |
| 4,364,353 | 12/1982 | Fiala | 123/435 |
| 4,487,186 | 12/1984 | Wahl et al. | 123/478 |
| 4,561,401 | 12/1985 | Hata et al. | 123/435 |
| 4,625,690 | 12/1986 | Morita | 123/435 |
| 4,688,535 | 8/1987 | Küttner et al. | 123/436 |
| 4,706,628 | 11/1987 | Trombley | 123/425 |
| 4,736,724 | 4/1988 | Hamburg et al. | 123/435 |

FOREIGN PATENT DOCUMENTS

| | | | |
|---|---|---|---|
| 57-59039 | 4/1982 | Japan . | |
| 58-217722 | 12/1983 | Japan | 123/435 |
| 59-46352 | 3/1984 | Japan | 123/435 |

*Primary Examiner*—Andrew M. Dolinar

*Attorney, Agent, or Firm*—Antonelli, Terry & Wands

[57] ABSTRACT

An engine control apparatus for assuring stabilized operating performance by detecting the combustion state of gas mixture within an engine cylinder and determining the amount of air supplied to the cylinder in dependence on the detected combustion state.

7 Claims, 6 Drawing Sheets

ENGINE CONTROL APPARATUS

BACKGROUND OF THE INVENTION

1. Field of the Invention

The present invention relates to an apparatus for controlling an internal combustion engine of a motor vehicle in which an accerelator pedal and a throttle valve are not mechanically linked together but interconnected electrically.

2. Description of the Prior Art

In the hitherto known motor vehicles, the accerelator pedal and throttle valve are mechanically linked in such a manner that when the accelerator pedal is depressed, the throttle valve is opened correspondingly, whereby the output power of the engine is controlled. In the case of this type engine control system, the fuel injection pulse width is determined by dividing the number of cycles of rotation of the engine by the amount of air flow supplied to the engine. Reference may be made, for example, to Japanese Patent Unexamined Publication No. 57-59039 (JP-A-No. 57-59039).

In most of the hitherto known motor vehicles, when the throttle valve is opened, the amount of air flow corresponding to the opening degree of the throttle valve is supplied to the engine without any appreciable delay. In contrast, with respect to the fuel, there can not always be obtained the amount of fuel which corresponds to the abovementioned amount of air flow, because of a delay or similar factor intervening between the detection of the amount of air and the engine rotation number, resulting in an undesirable influence on the operation performance of the engine.

Further, the operation performance of the engine and hence the motor vehicle is more or less degraded because of changes occurring in the rotation number even in the course of driving at a constant speed under the influence of non-uniform combustion and road conditions. However, no consideration has heretofore been paid to this problem. In other words, preference is put on the air flow control, which often results in improper A/F ratio transiently, accompanied by variations in the engine rotation number and the bumping of the motor vehicle during constant speed operation, and hence discomfort in driving the car occurs.

SUMMARY OF THE INVENTION

It is therefore an object of the present invention to provide an engine control apparatus for controlling the fuel-air (A/F) ratio to thereby improve the operation performance of an internal combustion engine by correcting at least either one of the amount of air flow or the amount of fuel supplied to the engine cylinder(s).

In view of the object mentioned above, there is provided according to an aspect of the present invention an engine control apparatus which comprises detecting means for detecting the combustion state in the engine, and means for correcting the amount of air flow determined by the engine operating conditions, such as the degree of depression (stroke) of the accelerator pedal or the like, in dependence on the detected engine state.

According to a second aspect of the present invention, there is provided an engine control apparatus which comprises detecting means for detecting the combustion state in the engine, and means for correcting the amount of fuel in dependence on the combustion state as detected and then correcting the amount of air determined by the operating condition, such as the degree of depression (or stroke) of the accelerator pedal, in accordance with the correction mentioned above.

According to the first aspect of the invention, the amount of air flow fed to the engine cylinder can be corrected in accordance with the combustion state to thereby vary the A/F ratio.

According to the second aspect of the invention, the amount of fuel supplied to the engine cylinder can first be corrected in dependence on the combustion state and then the amount of air can be corrected in dependence on the correction of the fuel amount, to thereby vary the A/F ratio correspondingly.

DESCRIPTION OF THE PREFERRED EMBODIMENT

Now, the invention will be described in detail in conjunction with an exemplary embodiment thereof.

Figure 1:
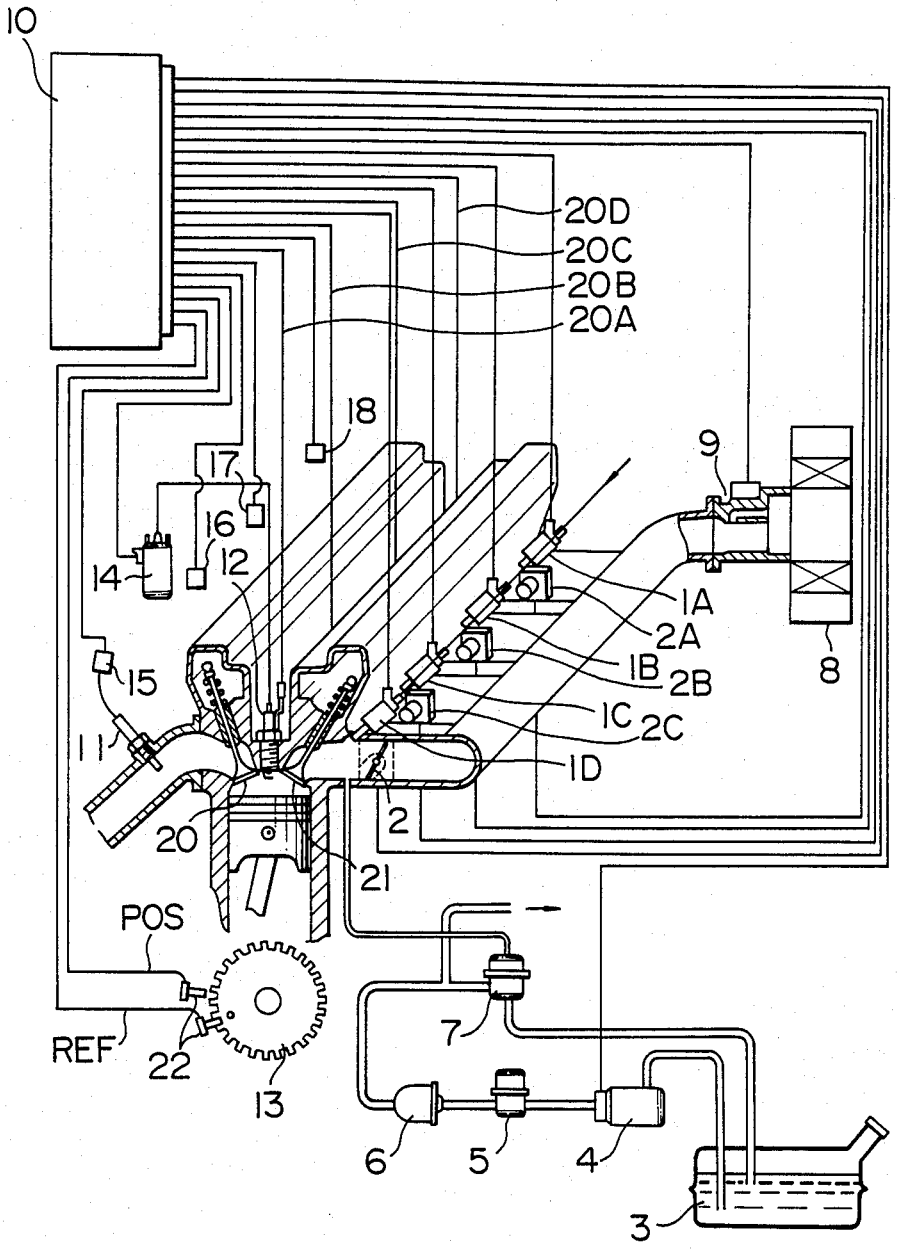
FIG. 1 is a view showing an engine control apparatus according to an exemplary embodiment of the present invention.

FIG. 1 is a view showing an engine control apparatus according to an embodiment of the present invention. In the illustrated embodiment, it is assumed that the engine includes four cylinders identified by labels "No. 1" to "No. 4", respectively. The engine is supplied with fuel through fuel injectors 1A to 1D installed in correspondence to the cylinders, respectively. The amount of air flow supplied to the engine is controlled by throttle valves 2 also provided in association with the cylinders, respectively, (it is however to be noted that only one throttle valve is shown with those for the other three cylinders being omitted from illustration).

The fuel supply to the fuel injectors 1A to 1D is effectuated from a fuel tank 3 through a pump 4 by way of a damper 5 and a filter 6. A fuel pressure regulator 7 is employed for regulating vacuum or negative pressure.

The air supply to the four throttle valves typified by the throttle valve 2 takes place from an air cleaner 8 through a hot-wire type air flow sensor section 9. The opening degrees of the four throttle valves are controlled by throttle valve actuators 2A to 2D, respectively.

A control unit 10 includes a computer as a main component and performs various monitoring functions as well as control functions. As the objectives for the control, there may be mentioned the amount of fuel, ignition timing and others. For effectuating the various monitoring and control functions, various status quantities of the vehicle are fetched by the computer. These quantities are detected by various sensors.

Some types of sensors and the quantities as detected by the sensors are as follows:

Exhaust gas sensors (A/F) 11: $O_2$-sensor, lean sensor, wide-range A/F sensor and the like belong to this category and are employed for detecting air/fuel ratio (also referred to as A/F ratio). The sensor(s) is provided for each of the cylinders. In the drawing, only one sensor is shown with the others being omitted for clarification of the illustration. Connectors 15, 16, 17 and 18 serve as outlets for taking out the outputs from the sensors.

Combustion pressure sensors 12: These sensors are employed for detecting the combustion pressure and are provided for the cylinders, respectively. In the drawing, only one of the sensors is shown. The outputs of the fuel pressure sensors are taken out by means of lead wires 20A to 20D, respectively.

Crank angle sensors 22: These sensors are employed for monitoring the rotation of a ring gear coupled to a crank shaft for producing an angle signal (POS) and a cylinder identification signal (REF), respectively.

Hot-wire type air flow sensor 9: This sensor is employed for detecting the amount or flow of suction air.

Additionally, the following sensors are used.

Throttle sensors: These sensors serve to detect the opening degrees of the associated throttle valves 2, respectively, and produce signals which are utilized in controlling the opening degrees of the associated throttle valves. In other words, this sensor is provided for each throttle valve of each cylinder.

Accelerator pedal stroke sensor: This sensor serves to detect the opening or depression degree (hereinafter also referred to as stroke) of an accelerator pedal. In general, in motor vehicles, the throttle valve is actuated in an interlocking manner with the accelerator pedal. However, it should be noted that the present invention is directed to a motor vehicle in which such mechanical interlock is absent. Accordingly, the opening degree of the throttle valve can not be directly determined from the stroke of the accelerator pedal detected by the accelerator pedal stroke sensor.

Idle switch: This switch gives information concerning the idle state in terms of "ON" and "OFF" signals.

Water temperature sensor: This sensor serves to detect the temperature of the coolant.

Battery voltage detector: This detector is used for detecting the battery voltage.

The control unit 10 fetches as the inputs thereto the detected values of the aforementioned quantities from the various sensors and the idle switch for the purpose of monitoring as well as arithmetic processing and control. the objectives for con trol and the processing are as follows:

Throttle actuators 2A–2D: In accordance with the signals supplied from the control unit 10, these actuators control the associated throttle valves 2 with magnitude of the control as performed being detected by the throttle sensors incorporated in the actuators.

Fuel injectors 1A–1D: In accordance with the signals issued by the control unit 10, the fuel injectors are opened to inject the fuel into an intake manifold.

Ignition coil 14: In accordance with the signal supplied from control unit 10, the ignition timing is controlled.

Fuel pump 4: in accordance with the signal supplied from the control unit 10, the fuel pump undergoes ON-OFF control.

Figure 2:
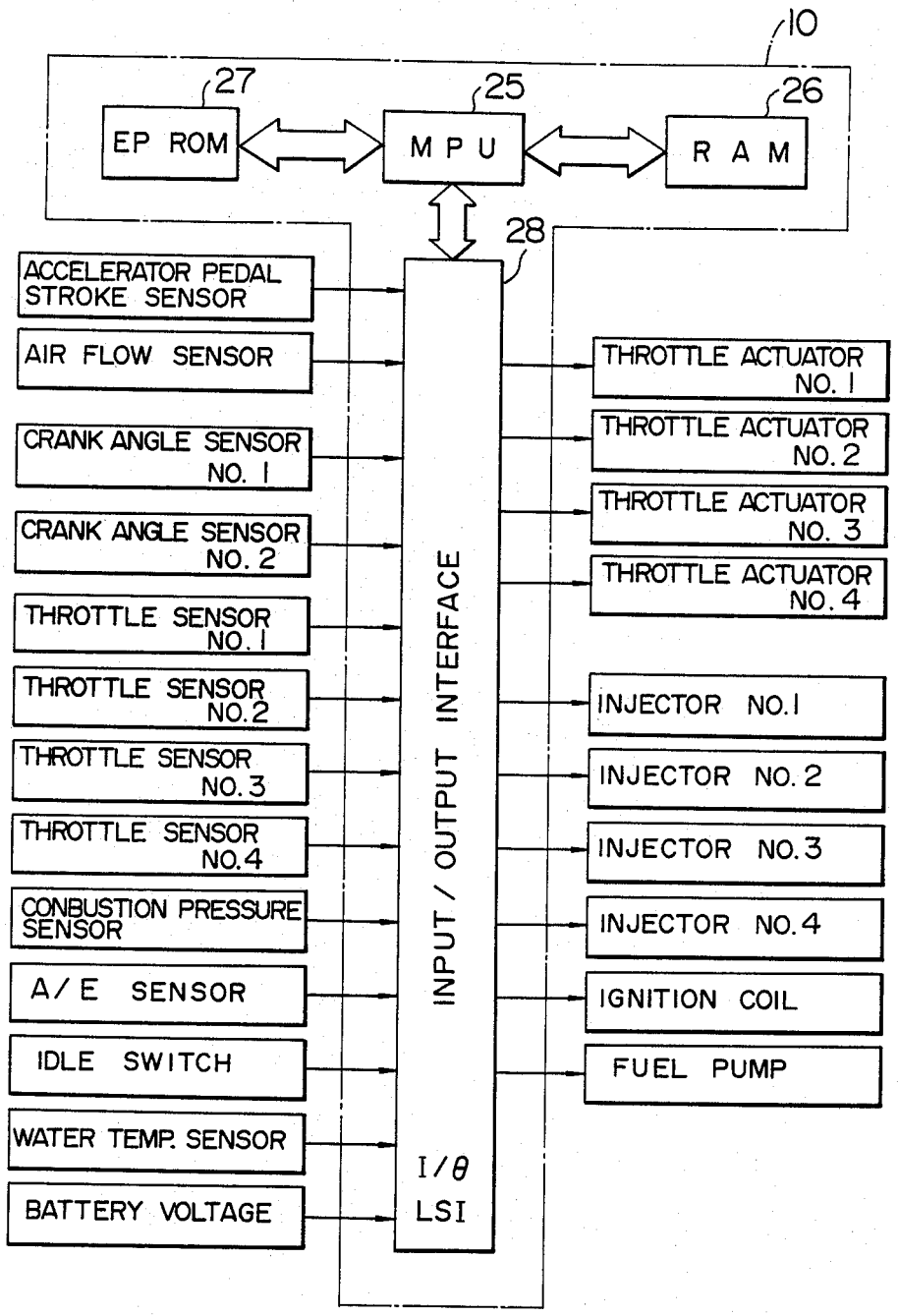
FIG. 2 is a view illustrating systematically the processing which can be executed in carrying out the teaching of the invention.

FIG. 2 illustrates schematically the aforementioned monitoring and controlling functions of the control unit 10 serving as the central processing and control unit. The control unit 10 is composed of a microprocessor (MPU) 25, a random access memory (RAM) 26, a read-only memory (ROM) 27 and an input/output interface 28. The ROM 27 stores microprograms, while the MPU 25 executes processing in accordance with the microprogram. The RAM 26 serves to store therein various data.

The MPU 25 fetches therein various status quantities or data available from the various sensors or switches through the input/output interface 22 and performs monitoring and processing functions in accordance with the programs stored in the ROM 27, whereby the output signals resulting from the execution of the processing are sent to the relevant devices to be controlled (such as actuators, injectors, ignition coil and others) through the input/output interface 23 for effecting control of these components.

Figure 3:
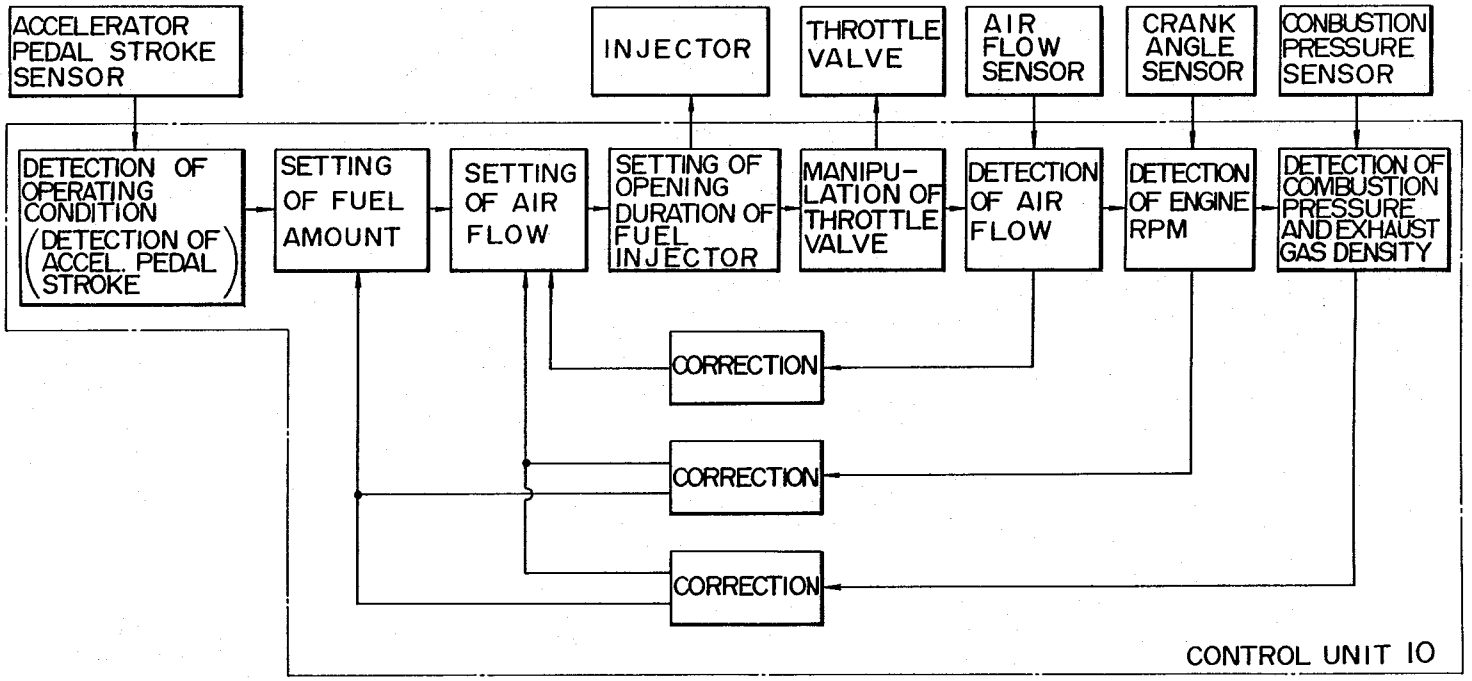
FIG. 3 is a view illustrating in a flow chart the processing which can be executed in carrying out the present invention.

FIG. 3 shows a flow chart for illustrating operations executed by the control unit 10. At first, the operating conditions are detected. With the phrase "operating conditions", referance is made to the stroke (degree or extent of depression) of the accelerator pedal detected by the accelerator pedal stroke sensor, the number or cycles of rotation of the engine detected by the crank angle sensor and other conditions. In the following description, it is assumed that the stroke of the accelerator pedal and the engine revolution or rotation number are made use of.

Next, a fuel injection pulse width $T_i$ is read out from a fuel map stored in the ROM 27. With the phrase "fuel injection pulse width $T_i$", it is intended to refer to a time duration (period) during which the fuel is injected from the fuel injector. Accordingly, the amount of injected fuel is definitely determined as a function of this pulse width $T_i$. The fuel map is a sort of table which contains as the data the fuel injection pulse width $T_i$ determined by the accelerator pedal stroke and the engine rotation number with both the parameters being used as table addresses.

The amount of air supply is determined from the air flow map sotred in the ROM 27. Since the amount of air supply is determined as a function of the opening degree of the throttle valve, the amount of air supply (i.e. air flow) may be represented by the opening degree $\theta_{th}$ of the throttle valve. With the phrase "air supply map", it is intended to mean a sort of table which contains as data the throttle valve opening degree $\theta_{th}$ determined as a function of the engine rotation number and the fuel injection pulse width with both the parameters being used as the addresses of the map. As described hereinbefore, in the motor vehicles to which the invention is directed, the accelerator pedal is not mechanically linked to the throttle valve but interconnected electrically through the control unit 10. Accordingly, the control unit 10 fetches the accelerator pedal stroke to determine first the amount of fuel supply for controlling correspondingly the fuel injection pulse width $T_i$. Subsequently, the opening degree $\theta_{th}$ of the throttle valve is determined in accordance with the determined amount of fuel supply to thereby correspondingly control the throttle valve so that the determined opening degree is established. This opening degree $\theta_{th}$ of the throttle valve can be obtained from the air supply map.

Next, the pulse width ($T_i$) signal is sent to a drive unit of the injector for causing the fuel injection to be carried out over the time span corresponding to the injection pulse width $T_i$. Further, the throttle opening degree ($\theta_{th}$) signal is sent to the throttle valve actuator to thereby set the opening degree of the throttle valve at the determined value $\theta_{th}$.

Through the procedure described above, amounts of the fuel injection and the air supply are determined appropriately. In dependence on these determined quantities or values, the appropriate A/F ratio control as well as the air and fuel supply control is performed. In this connection, it will be seen that operating conditions of the motor vehicle vary from time to time and that the combustion conditions in the engine also undergoes changes from time to time.

Under the circumstances, the illustrated embodiment is so arranged as to correct the amounts of fuel and air flow in consideration of the combustion state and the operating conditions.

The correction is illustrated in FIG. 3. With respect to the fuel amount, the correction is performed by utilizing the engine rotation number detected by the crank angle sensor and the combustion pressure (or exhaust gas density or concentration detected by the A/F sensor).

Concerning the amount of air supply, correction is made on the basis of the air flow quantity detected by the air flow sensor, the engine rotation number detected by the crank angle sensor and the combustion pressure detected by the combustion pressure sensor (or alternatively the exhaust gas density detected by the A/F sensor).

(i) Correction of the amount of fuel supply

The amount of fuel supply is determined by the time for which the injector valve is opened, i.e. by the fuel injection pulse width $T_i$. Accordingly, the correction of the amount of fuel supply means the correction of the pulse width $T_i$.

On the other hand, the pulse width $T_i$ can be determined by referring to the map containing the data of the accelerator pedal stroke and the engine rotation number. In other words, the pulse width $T_i$ can be definitely determined by the accelerator pedal stroke and the engine rotation number as detected by referring to the map.

However, even when the A/F ratio which is appropriate to the operating conditions can be obtained, there may take place non-uniform combustion and/or variation in the engine rotation number under the influence of road condition or the like factors. Accordingly, the fuel injection pulse width $T_i$ is so corrected as to suppress the influence of variations in the engine rotation number.

Further, the combustion pressure level can be definitely determined by consulting the map containing the data of the accelerator pedal stroke and the engine rotation number. There may however arise such situation in which the combustion pressure detected by the combustion pressure sensor can differ from the desired combustion pressure obtained from the abovementioned map. It goes without saying that the former should coincide with the latter. Accordingly, the fuel injection pulse width $T_i$ is so corrected that the difference mentioned above becomes zero. Alternatively, the weighted mean value of the fuel pressures detected over a past period is determined, whereby the injection pulse width $T_i$ is so corrected that the difference between the weighted mean value and the desired combustion pressure becomes zero.

(ii) Correction of the amount of air supply

The amount of air supply is definitely determined from the map of the engine rotation number and the fuel injection pulse width $T_i$. The amount of air supply is a function of the opening degree $\theta_{th}$ of the throttle valve. Accordingly, the correction of the amount of air supply can be realized by correcting correspondingly the throttle opening degree $\theta_{th}$.

The correction of the opening degree $\theta_{th}$ is performed when the detected combustion state and engine rotation number differ from the respective desired values, as in the case of the correction of the fuel injection pulse width $T_i$.

It should be mentioned here that the correction of the throttle opening degree $\theta_{th}$ is performed in accordance with the correction of the fuel injection pulse width $T_i$ or alternatively the amount of air supply is corrected solely for each cylinder independently or in association or coordination with the correction of the amounts of air supply to other cylinders. Further, at the throttle opening degree $\theta_{th}$ which assures the A/F ratio and the amount of the mixture proper to the current operating condition, a difference possibly existing between the detected combustion pressure and the desired value thereof (determined in dependence on the operating conditions) is determined to thereby correct the throttle opening degree $\theta_{th}$ in accordance with the magnitude of the difference.

(iii) Fuel injection system

Figure 4:
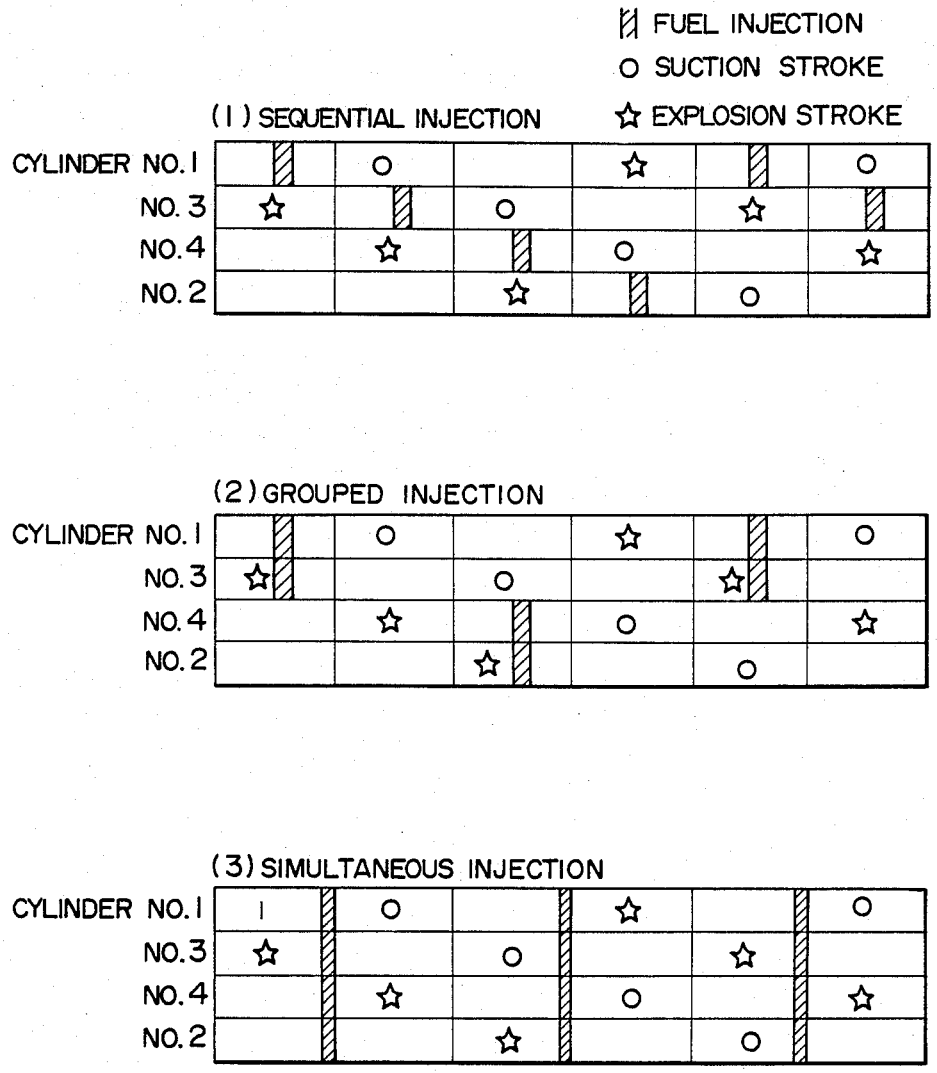
FIG. 4 is a view for illustrating examples of engine control.

The fuel injection system as employed is determined in dependence on the manner in which the cylinder is controlled. Typical examples of fuel injection systems are illustrated in FIG. 4. According to a so-called sequential injection system (1), the fuel injection is performed for each cylinder independent of the others, wherein the fuel injection takes place in the sequential order of the cylinder No. 1, the cylinder No. 3, the cylinder No. 4 and the cylinder No. 2.

In the case of a group injection system (2), the cylinders are grouped into two sets including a set of the cylinders Nos. 1 and 3 and the other set of the cylinders Nos. 4 and 2, wherein the fuel injection to the cylinders No. 1 and No. 3 is performed simultaneously while the fuel injection being conducted also simultaneously to both the cylinders Nos. 4 and 2.

In the case of a simultaneous injection system (3), the fuel injection is carried out simultaneously to all the cylinder Nos. 1 to 4.

The illustrative embodiment of the present invention can be adopted in combination with any one of the abovementioned fuel injection systems. In the case of the sequential injection system and the group injection system, it is desirable that the fuel injection be carried out in the course of the exhaust stroke. In the case of the simultaneous injection system, the fuel injection should preferably take place in the vicinity of the top dead point or the bottom dead point.

(iv) Air flow control timing

Most preferably, control of the amount of air supply should be performed at a time point immediately before the start of the suction stroke. However, at the expense of some degree of degradation in the performance, no specific control timing is required to be preset.

Figure 5:
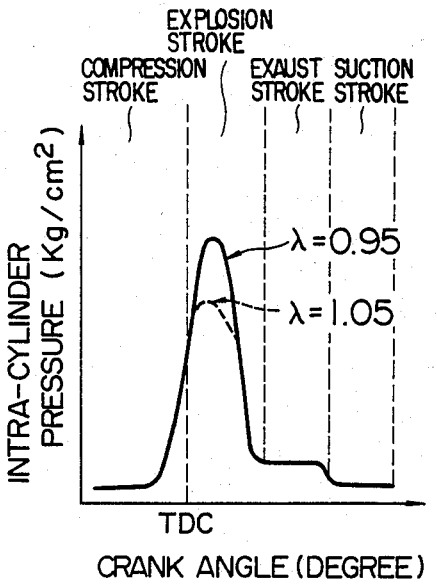
FIG. 5 is a view for illustrating graphically a relationship between a crank angle and pressure within an engine cylinder.
Figure 6:
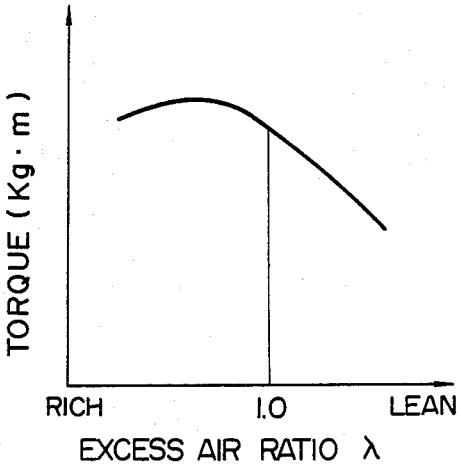
FIG. 6 is a view for illustrating a relation between excess air ratio and torque.
Figure 7:
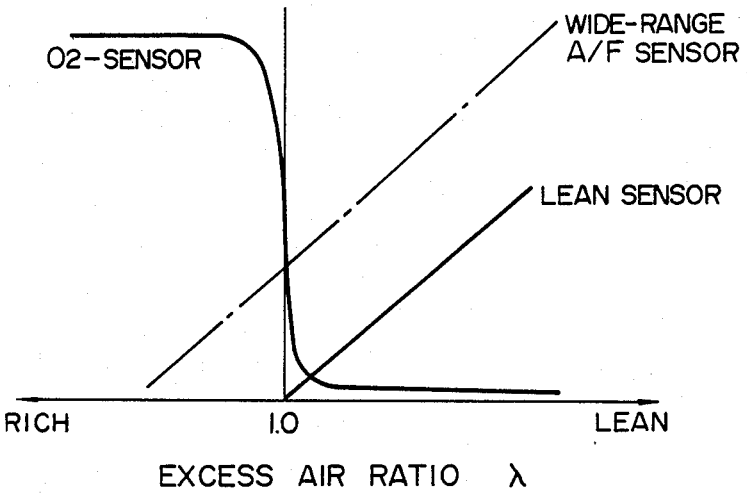
FIG. 7 is a view for illustrating relationships between the excess air ratio and characteristics of various sensors.

Next, description will be made on the combustion pressure. FIG. 5 is a view for illustrating a relation between the crank angle and the combustion pressure. The combustion pressure attains a maximum value in the explosion stroke. The maximum pressure is decreased as the excess air ratio λ is increased and vice versa. FIG. 6 is a view for illustrating a relation between the excessive air ratio λ and torque. FIG. 7 is a view for illustrating graphically the detection characteristics of an oxygen ($O_2$) sensor, a wide range A/F sensor and a lean sensor, respectively. The excess air ratio λ equal to 0.1 means that the A/F ratio is equal to the theoretical air-fuel ratio (14.7). The sensors having characteristics appropriate to intended applications should be used.

Figure 8:
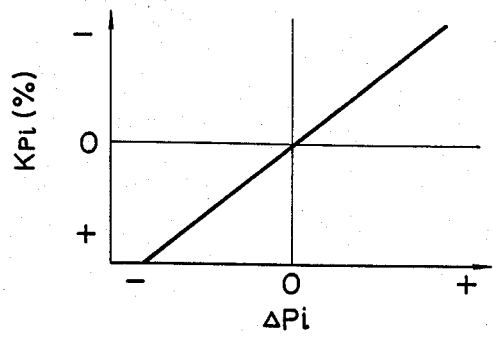
FIGS. 8 to 10 are views for illustrating various coefficients which can be employed for performing corrections according to the invention.
Figure 9:
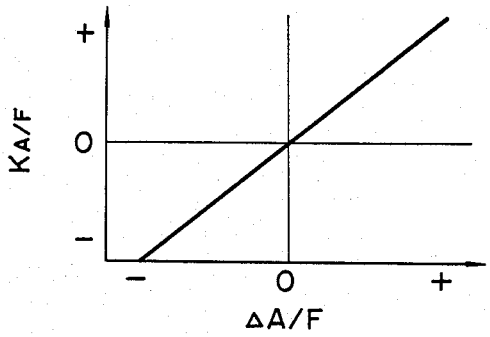
Figure 10:
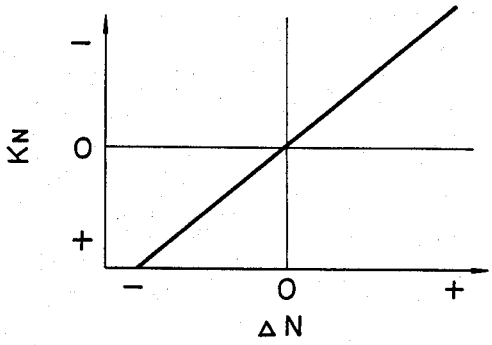

In connection with the corrections described hereinbefore, correction coefficients may be previously set for use in the corrections. FIG. 8 is a view illustrating an example of the correction coefficient. As will be seen, a correction coefficient having a straight line slope except for a predetermined dead zone is established as a function of deviation of ΔPi of the combustion pressure. FIG. 9 shows a correction coefficient K (A/F) for correcting deviation ΔA/F of the exhaust gas density A/F, and FIG. 10 is a view illustrating a correction coefficient $K_N$ for rotation number deviation ΔN.

Since the amount of air flow to the cylinders can be controlled separately and independently according to the illustrated embodiment, the combustion can be maintained at the most desirable condition in each of the individual cylinders.

According to the present invention, the engine rotation number may be made use of in addition to the accelerator pedal stroke as the engine operation parameter. Further, the detection output of the A/F sensor may be utilized as a parameter representative of the combustion state in place of the combustion pressure. Further, both of the A/F sensor output and the combustion pressure may be utilized. Besides, the correction of the amount of air supply may be made on the basis of the grouped cylinder sets.

We claim:

1. An engine control apparatus, comprising:

first means for detecting an operating condition of an acceleration pedal;

second means for determining a basic amount of fuel to be supplied to each cylinder of the engine on the basis of said detected operating condition of said acceleration pedal as detected by said first means;

third means for individually controlling the amount of air supplied to each engine cylinder;

fourth means for directly detecting the combustion pressure in each engine cylinder; and fifth means responsive to said fourth means for determining a correction value for correcting said basic amount of fuel determined by said second means and for correcting the amount of air supplied as controlled by said third means in accordance with the correction of said fuel amount so as to make said combustion pressure in each cylinder of said engine equal;

sixth means for determining an supply amount of fuel on the basis of said basic amount of fuel determined by said second means and said correction value determined by said fifth means; and seventh means for supplying fuel on the basis of said supply amount of fuel determined by said sixth means.

2. An engine control apparatus according to claim 1, further comprising means for storing target combustion pressure values in accordance with different operation conditions of said acceleration pedal and means for selecting a target combustion pressure by reading a combustion pressure value stored in said storing means in response to said first means, and said fourth means includes means for generating a correction value for each cylinder such that said combustion pressure in each cylinder becomes substantially equal to said target combustion pressure obtained from said storing means.

3. An engine control apparatus according to claim 1, further comprising means for determing an average value of said combustion pressures for all cylinders, and said fourth means includes means for generating a correction value such that said combustion pressure of each cylinder becomes substantially equal to said average value.

4. An engine control apparatus, comprising:

first means for controlling the amount of fuel supply to the engine on the basis of a detected operating condition of the engine;

second means for controlling the amount of air supplied to each engine cylinder;

detecting means for directly detecting the combustion pressure in each engine cylinder; and third means for correcting said amount of fuel supply controlled by said first means in accordance with the combustion pressure detected by said detecting means;

wherein said detecting means comprises a compression detector for each engine cylinder, and said second means comprises means responsive to said first means and said detecting means for controlling the amount of air so as to equalize the combustion pressure in each of said engine cylinders.

5. An engine control apparatus according to claim 4, further including fourth means for correcting the amount of air supplied as controlled by said second means in accordance with the correction of the fuel amount effected by said third means.

6. An engine control apparatus, comprising: engine condition detecting means for detecting an engine condition; target combustion pressure determining means for determining a target combustion pressure for each engine cylinder on the basis of an output from said engine condition detecting means; plural combustion pressure detecting means for detecting the combustion pressure in each respective engine cylinder; comparing means for comparing the target combustion pressure from said target combustion pressure determining means with a value of combustion pressure directly detected by said plural combustion pressure detecting means for each engine cylinder; and controlling means for controlling said engine on the basis of an output from said comparing means so as to make the combustion pressure in each engine cylinder equal to said target combustion pressure.

7. An engine control apparatus, comprising: operation condition detecting means for detecting an operation condition of an acceleration pedal; plural combustion pressure detecting means for detecting the combustion pressure in respective engine cylinders; fuel amount determining means for determining a fuel amount to be supplied to the engine on the basis of an output from said operation condition detecting means; and suction air amount determining means for determining a suction air amount so as to equalize the combustion pressure in each of said engine cylinders on the basis of the outputs from said fuel amount determining means and said combustion pressure detecting means.

* * * * *